US005930880A

United States Patent [19]

Toeniskoetter

[11] Patent Number: 5,930,880

[45] Date of Patent: Aug. 3, 1999

[54] INTENSIFICATION METHOD AND APPARATUS FOR HEMMING MACHINE

[75] Inventor: James B. Toeniskoetter, Rochester Hills, Mich.

[73] Assignee: TESCO Engineering, Inc., Auburn Hills, Mich.

[21] Appl. No.: 09/020,226

[22] Filed: Feb. 6, 1998

[51] Int. Cl.[6] ..... B23P 11/00

[52] U.S. Cl. ..... 29/243.5; 29/251; 100/271

[58] Field of Search ..... 29/251, 252; 100/219, 100/270, 271, 289, 291, 292, 243.5

[56] References Cited

U.S. PATENT DOCUMENTS

| | | | |
|---|---|---|---|
| 3,370,339 | 2/1968 | Soulet | 29/252 |
| 4,201,130 | 5/1980 | Stahl | 100/271 |
| 4,213,365 | 7/1980 | McCabe | 100/270 |
| 5,272,903 | 12/1993 | Evans | 100/271 |
| 5,495,742 | 3/1996 | Dorsett | 100/271 |
| 5,596,923 | 1/1997 | Enami | 100/271 |

*Primary Examiner*—David A. Scharbel
*Assistant Examiner*—Daniel G. Shanley
*Attorney, Agent, or Firm*—Fildes & Outland, P.C.

[57] ABSTRACT

A closure panel hemming apparatus includes a lower support supporting a lower hemming die and an upper support spaced from and mounted above the lower support supporting an upper hemming die. The upper and lower supports are relatively vertically moveable for bringing the dies toward and away from one another. A plurality of actuators of the ball screw or rack and pinion type is driveably connected to draw together the upper and lower supports, bringing the dies together for edge hemming preformed metal panels nested between the dies. Force application means including one or more clamps are actuated to connect the upper and lower supports upon their movement of the dies to a hemming position. Force is applied to the clamp(s), through separate means or by intensification means driven by the actuators, to draw the dies tightly together for completing the hemming operation. Use of the additional force application means for applying hemming force to the dies allows smaller actuators to be used for the macro movements of the dies.

16 Claims, 7 Drawing Sheets

20
386
268
16
266
272
390
388
14
22
276
12
274
30
18
310

20
386
16
268
266
272
390
388
14
22
276
12
274
30
18
310

20
386
16
268
266
272
390
14
388
22
276
12
274
30
18
310

INTENSIFICATION METHOD AND APPARATUS FOR HEMMING MACHINE

FIELD OF THE INVENTION

This invention relates to hemming apparatus for joining two preformed metal panels together to form a closure panel and more particularly to a hemming apparatus using a plurality of actuators for drawing together hemming dies and an intensification feature for multiplying the hemming pressure of the actuators.

BACKGROUND OF THE INVENTION

In U.S. patent application Ser. No. 08/938,692 assigned to the assignee of the present invention, a closure panel hemming apparatus is disclosed that includes a lower support supporting a lower hemming die and an upper support, spaced from and mounted above the lower support and supporting an upper hemming die. The upper and lower supports are relatively vertically moveable for moving the dies toward and away from one another. At least one guide post interconnects the upper and lower supports and maintains alignment of the upper and lower supports, during movement thereof. A plurality of actuators of the ball screw or rack and pinion type are driveably connected to draw together the upper and lower supports, bringing the dies together for edge hemming preformed metal panels nested between the dies.

The disclosed hemming apparatus has significant cost and control benefits over conventional press style hemming machines, yet requires actuators having sufficient size to impart the required hemming tonnage.

SUMMARY OF THE INVENTION

The present invention provides a closure panel hemming apparatus having an intensification feature that allows the drawing force of the actuators to be intensified or multiplied to thereby impart intensified hemming pressure from minimally sized actuators.

More specifically, the closure panel hemming apparatus comprises a lower support supporting a lower hemming die and an upper support spaced from and mounted above the lower support and supporting an upper hemming die. The upper and lower supports are relatively vertically moveable for moving the dies toward and away from one another. A plurality of support drive actuators are driveably connected to draw together the upper and lower supports, bringing the dies together for hemming. A clamp, pivotally mounted relative to one (a first support) of the upper and lower supports is operatively engageable with the other (second) of the said supports. An engagement actuator actuates engagement of the clamp member with the other of the supports and a force application means moves the supports together with intensified force during engagement of the clamp to impart the required hemming pressure.

In one embodiment, the clamp is of a modified C-shape including first and second ends. The first end is pivotally mounted on the first support. A link engageable with the second support is pivotally connected to the clamp between the first and second ends. The force application means is mounted on the clamp second end and has an operative connection with the link to pivot the link toward the first end of the clamp and force a distal end of the link against the second support, thereby applying an intensified hemming pressure between the supports proportional to the force of the force application means. The force application means may be of any suitable type, such as a hydraulic cylinder, an air over oil cylinder, or a crank arm assembly.

The engagement actuator may be a fluid actuator operatively connecting the first support, on which the clamp first end is mounted, and the clamp, intermediate the first end and the link, to pivot the clamp into and out of position for hemming upon activation of a fluid cylinder. Alternatively the engagement actuator may be a cam driver/follower assembly operatively mounted on one of the supports and the clamp to cam the clamp into and out of position.

In another embodiment of the invention, the closure panel hemming apparatus clamp is actuated by the action of the plurality of support drive actuators. In one arrangement, the clamp includes first and second ends and a cam shaped slot between the first and second ends for pivotal mounting of the clamp on a first one of the supports. An intensification lever arm having first and second ends is also pivotally mounted between its ends on the first support, on which the clamp is pivotally mounted. The intensification lever arm first end is pivotally connected to the clamp first end and the intensification lever arm second end is operatively connected for pivotal movement by one of the plurality of support actuators.

Tonnage control means intermediate the intensification lever arm second end and one of the plurality of support actuators controls the hemming pressure. In this arrangement, the tonnage control means includes a first mount mounted on one of the plurality of actuators and connected through first (overtravel) spring means with a second mount. The second mount is slidable on the first support on which the clamp is pivotally mounted and connected with that support through second (biasing) spring means having a smaller compression force than the first spring means. The second mount pivotally mounts the intensification lever arm second end. A linear bearing, mounted on the first support on which the clamp is pivotally mounted, slidably carries the first and second mounts for relative movement along the linear bearing.

Following movement of the lower and upper supports toward one another to a hemming position, the first and second mounts are drawn together toward the opposite (second) support along the linear bearing by continued rotation of the connected one of the actuators and the action of the stronger first (overtravel) spring means, thereby compressing the second (biasing) spring means. This causes the second mount to be moved upward along the linear bearing, causing actuating movement of the intensification lever arm to engage the clamp and then apply intensified closure pressure between the lower and upper hemming dies. Thereafter, compression of the first (overtravel) spring means controls hemming pressure and prevents excessive loading of the intensification mechanism prior to shutoff of the actuators.

In a second arrangement of the alternative embodiment, the tonnage control means includes a carriage mounted on one of the plurality of actuators. The first one of the upper and lower supports includes a linear bearing which mounts the carriage for movement relative to the support. A carriage spring means connects the carriage and the support whereby the carriage is moved and carriage spring compressed after the one of said actuators is driven to a hemming position of the supports. An overtravel spring means, operatively connecting the carriage and the intensification lever arm second end, causes the intensification lever arm to be pivoted during movement of the carriage downward, thereby causing engagement of the clamp and intensified hemming pressure to be exerted between the dies. When a predetermined pressure is reached, the overtravel spring means is compressed, limiting the hemming pressure on the dies.

In any of the disclosed embodiments, the plurality of support drive actuators that draw together the upper and lower supports may be ball screw actuators, rack and pinion actuators or linear drive actuators.

These and other features and advantages of the invention will be more fully understood from the following detailed description of the invention taken together with the accompanying drawings.

DETAILED DESCRIPTION OF THE INVENTION

Figure 1:
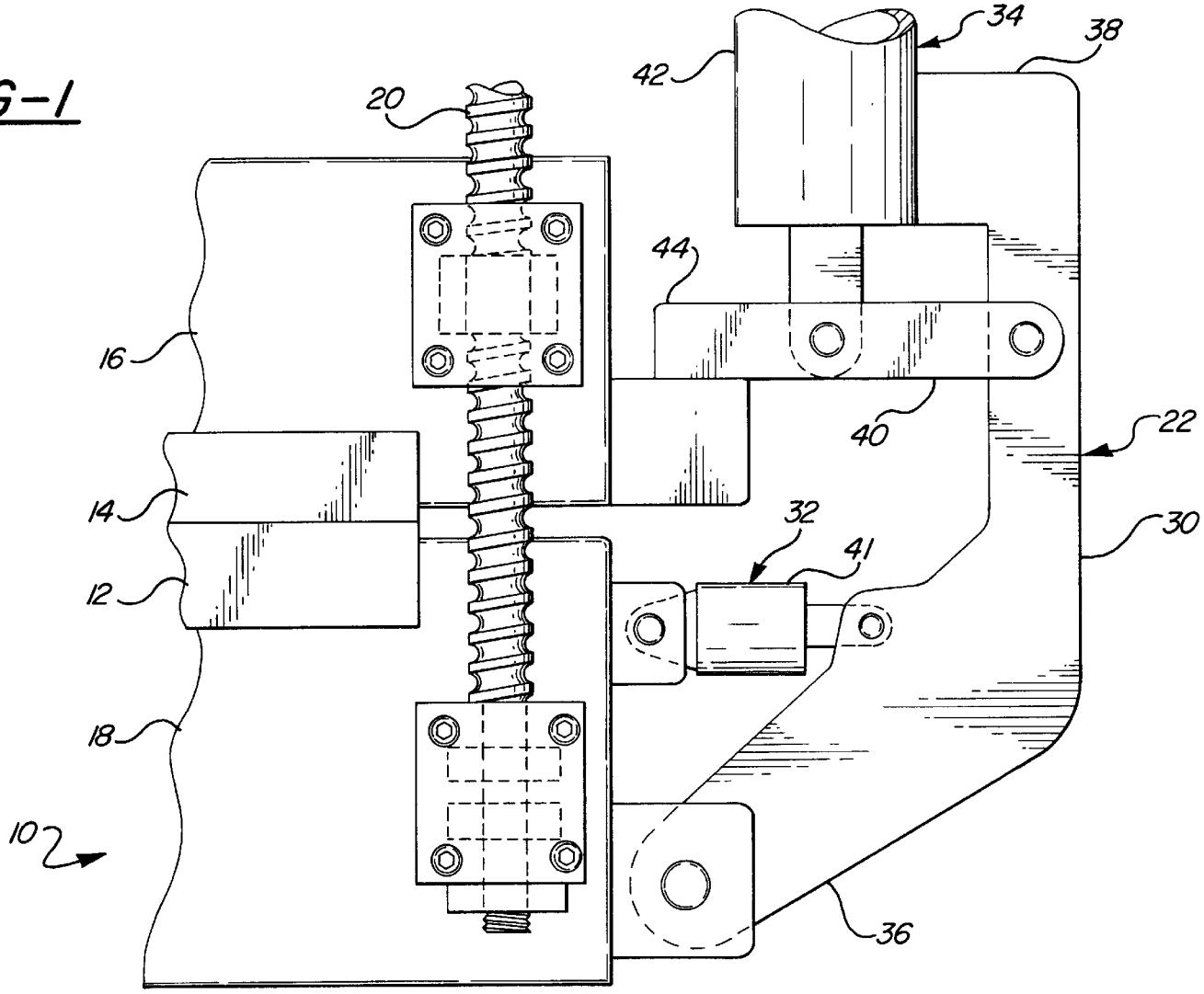
FIG. 1 is a fragmentary front view of a first exemplary embodiment of hemming apparatus according to the invention.

Referring now to the drawings in detail, numerals 10, 110 generally indicate hemming apparatus including lower and upper dies 12, 14. Dies 12, 14 are mounted on upward lower supports, 16, 18 respectively and are moveable relative to each other by a plurality of support drive actuators 20. Actuators 20 are driveably connected to draw together the upper and lower supports, bringing the dies 12, 14 together for edge hemming together the peripheries of nested metal panels to form a unitary closure panel such as a vehicle door, hood or trunk lid. As is hereinafter more fully described, hemming apparatus 10, 110, includes an intensification feature that applies increased force for moving the dies 12, 14 together during engagement of the nested metal panels between the dies.

Referring to FIGS. 1–8, the closure panel apparatus 10, 110, 210, 310 include a lower support 18 on which the lower die 12 is supported. An upper support 16 is spaced from and mounted above the lower support 18. Upper die 14 is supported on upper support 16. Alternatively, the upper support 16 and upper die 14 are intregal as are the lower support 18 and lower die 12.

The upper and lower supports 16, 18 are relatively vertically moveable for moving the dies 12, 14 toward and away from one another to perform hemming of preformed metal panels nested between the dies. Support drive actuators 20 are driveably connected to draw together the upper and lower supports 16, 18 for hemming. The drawings illustrate drive actuators 20 as being ball screw type actuators. However, drive actuators 20 may be known rack and pinion or linear type actuators.

In each of the herein disclosed closure panel hemming apparatus 10, 110, 210, 310 an intensification means 22 is provided for intensifying the hemming pressure applied to the nested panels between the upper and lower dies 12, 14. The intensification means is defined by a clamp 30, pivotally mounted relative to a first one of the upper and lower supports 16, 18 and operatively engageable with the second (other) of the supports. An engagement actuator 32 actuates engagement of the clamp member 30 with the second of the supports and a force application means 34 forces the supports 16, 18 together during engagement of the clamp 30 for final hemming of the nested metal panels.

Figure 2:
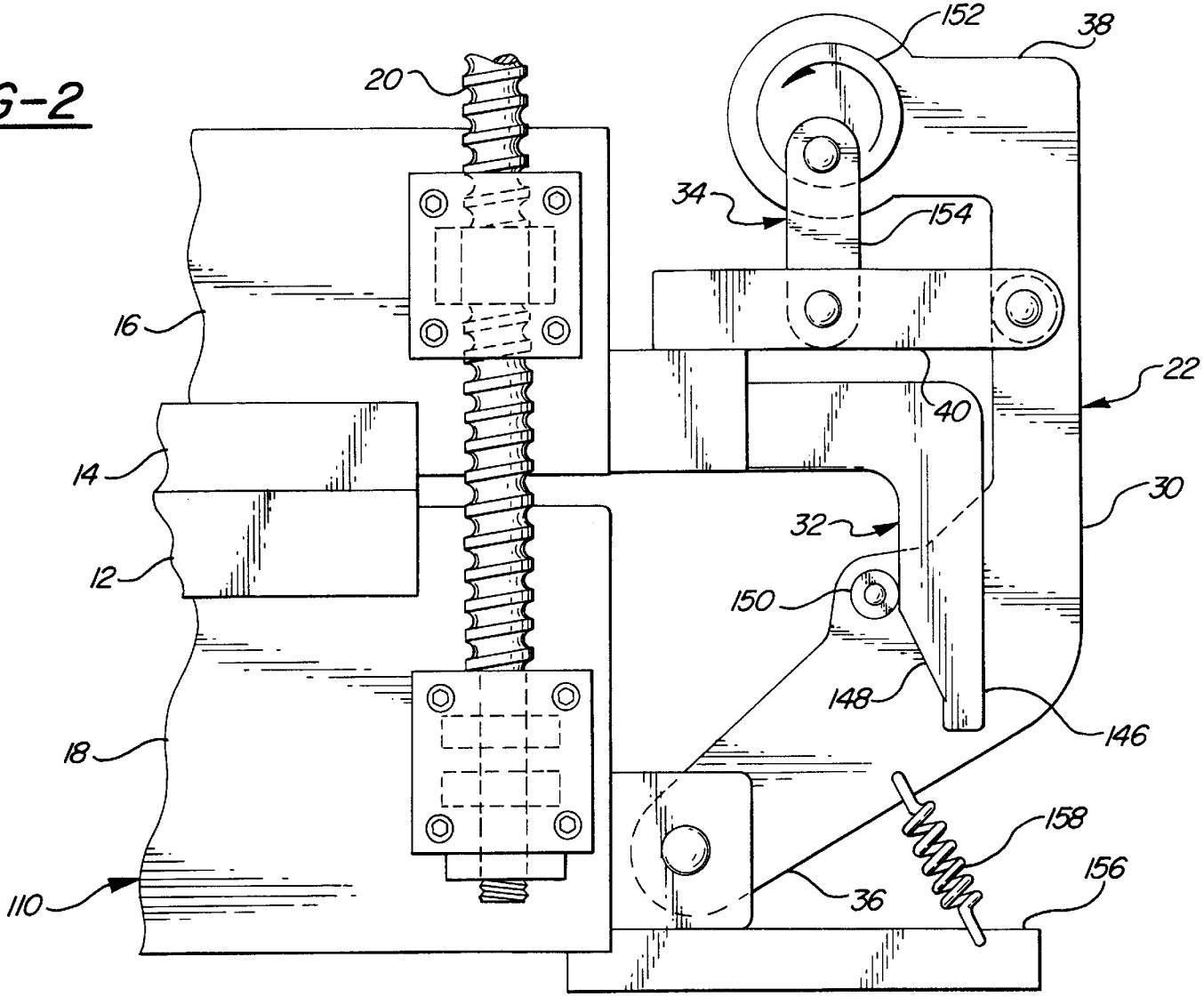
FIG. 2 is a view similar to FIG. 1 showing an alternative embodiment of the invention.

With reference to FIGS. 1–2, the clamp 30 includes first and second ends 36, 38. The first end 36 of the clamp is pivotally mounted on the first (lower) support 18. A link 40 engageable with the second (upper) support 16 is pivotally connected to the clamp 30 between its first and second ends.

As illustrated in FIG. 1, the engagement actuator 32 may be of any suitable type, such as engagement cylinder 41. The force application means 34 includes a fluid actuated force cylinder 42, such as a hydraulic or air over oil cylinder, mounted on the clamp second end 38. The force cylinder 42 has an operative connection with the link 40 to pivot the link to bring a distal end 44 of the link toward the first end 36 of the clamp, thereby applying a hemming pressure between the supports 16, 18 proportional to the force of the fluid actuated cylinder 42.

With continuing reference to FIG. 1, during operation of the closure panel hemming apparatus 10, the upper and lower supports 16, 18 are drawn together to draw the upper and lower dies 14, 12 together for hemming nested panels (not shown) mounted between the dies. Upon reaching a closed position of the dies 12, 14, the engagement actuator 32 (cylinder 41) is operated to draw the clamp 30 inward from an outwardly angled position, not shown, to the generally vertical position shown in FIG. 1. The force application means 34 (cylinder 42) is then actuated to pivot the link 40 downward into engagement with the second (upper) support 18 and apply a force drawing the first and second supports (in this case the lower and upper supports) closer together to complete hemming of the panels. The intensified force applied by the clamp 30 and force cylinder 42 provides the intensified force needed to complete the hemming operation and allows the drive actuators 16 to be of smaller size, since they are only required to move the supports 18, 20 toward and away from one another and not to apply the additional force needed for completing the hemming operation.

FIG. 2 illustrates a modified second embodiment of hemming apparatus 110 which is generally similar to apparatus 10 and in which like numerals indicate similar features or parts. Apparatus 110 differs from that of FIG. 1 in the form of the engagement actuator 32 and force application means 34 which form parts of the intensification means 22 actuating the clamp 30.

Engagement actuator 32 includes a cam driver 146 depending from the second (upper) support 16 and including an angled cam face 148. A follower 150, mounted on the clamp 30 is positioned to engage the cam face 148 as the supports 16, 18 are drawn closer together so as to cam the clamp 30 inwardly to the vertical position shown as the upper and lower dies 14, 12 are engaged in the hemming position. The force application means 34 comprises a rotary crank 152 connected by a connecting rod 154 with the link 40 which operates as before to engage the second (upper) support 16 and exert hemming force, drawing the supports 16, 18 together. The first (lower) support 18 is provided with an arm 156 mounting a spring 158 that engages the clamp 30 to bias it toward an angled (retracted) position to which it is moved when the supports 16, 18 are moved apart by the drive actuators 20.

Figure 4:
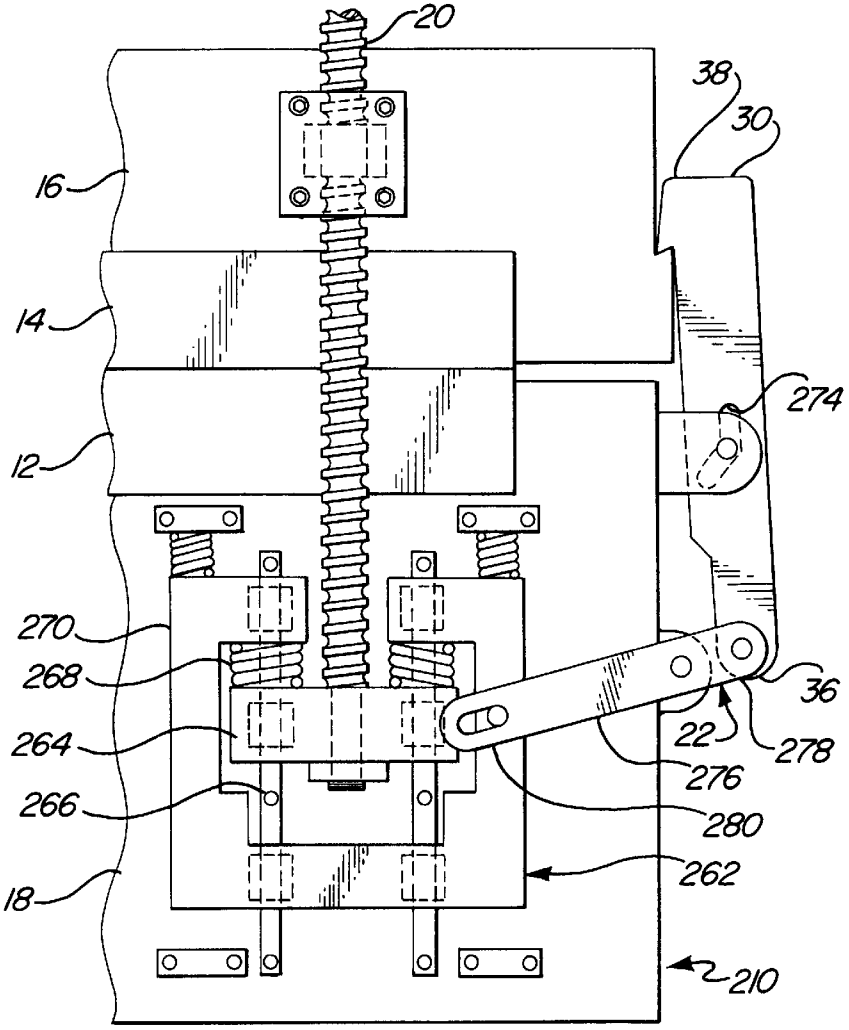
FIGS. 3 and 4 are views similar to FIG. 1 showing a third embodiment of the invention in initial and final actuating positions.
Figure 3:
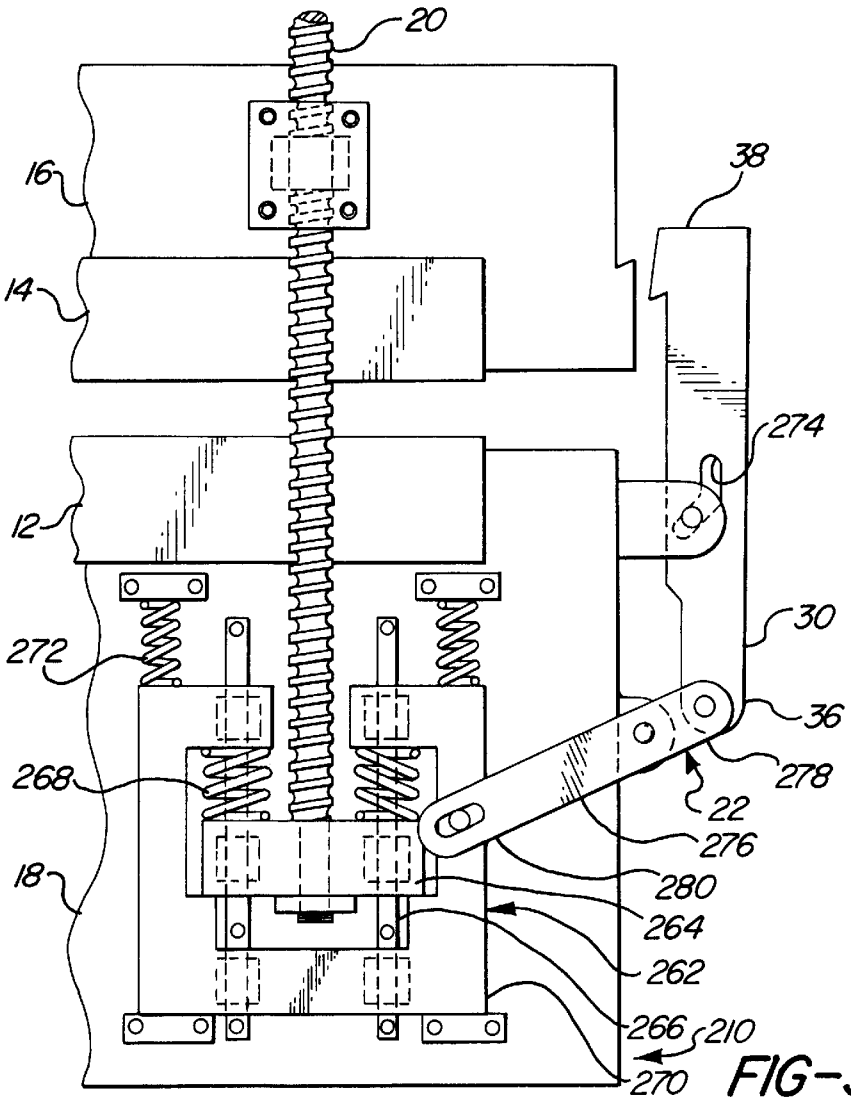

Referring now to FIGS. 3 and 4, a third embodiment of hemming apparatus 210 is illustrated wherein the drive actuators 20 that move the upper and lower supports 16, 18 together and apart, also apply the hemming force through intensification means 22 connected to actuate the clamp 30.

In the apparatus 210, of FIGS. 3 and 4, a drive actuator 20, in the form of a ball screw, connects the second (upper) support 16 to the lower (first) support 18 through a tonnage limiting means generally indicated by numeral 262. Means 262 includes a first mount 264 that is connected directly to the drive actuator 20 and is slideable on linear bearings 266 mounted on the first support 18. Relatively heavy overtravel springs 268 are compressed between the first mount 264 and a second mount 270, also slideable on the linear bearings 266 to normally bias the first mount 264 into engagement with internal shoulders of the second mount 270. Lighter biasing springs 272 are compressed between the second mount 270 and spring seats on the first (lower) support 18 to bias the second mount 270 downward against stops carried by the first (lower) support 18.

A clamp 30 has a first end 36 and a second end 38, the latter engageable with an angled clamp seat formed on the second (upper) support 16. Clamp 30 has a cam shaped slot 274 between its ends 36, 38 by which the clamp is pivotally mounted on the first (lower) support 18. An intensification lever arm 276 includes a first end 278, pivotally connected with the first end 36 of the clamp, and a second end 280 having a slot that is pivotally connected with the second mount 270. Lever arm 276 is also pivotally mounted between its ends on the first (lower) support 18 at a point closer to the first end 278 of the lever than to the second end 280 in order to use leverage to intensify the applied forces.

With continued reference to FIGS. 3 and 4, FIG. 3 shows the clamp 30 in its withdrawn position while the dies 12, 14 are separated by positioning of the second (upper) support 16 away from the first support 18. The drive actuator 20 is connected to the first mount 264 which is seated upon the second mount 270 that is in turn seated on the first (lower) support 18.

With a pair of panels, not shown, positioned for hemming between the upper and lower dies 14, 12, drive actuator 20 is operated to lower the upper second support 16 until the dies 12, 14 are in engagement as shown in FIG. 4. Continued travel of the ball screw or other drive actuator 20 after engagement of the dies, draws the first and second mounts 264, 270 upwardly together, compressing the lighter biasing springs 272 while the heavier overtravel springs 268 remain extended. The upward motion of the second mount 270 pivots the intensification lever arm 276, drawing the clamp 30 downward and moving its first end 236 inward to engage the clamp seat on the second (upper) support.

Further upward motion of the second mount 270 to the position shown in FIG. 4 pivots the intensification lever arm 276 further, drawing the clamp 30 down against the second support seat and applying an intensified hemming force between the first and second supports, thus completing the hemming operation of the panels, not shown. Upon overtravel of the drive actuator beyond the amount required for the hemming operation, the overtravel springs 268 are compressed as shown in FIG. 4, thereby limiting the force applied by the intensification means to a desired value within the capabilities of the apparatus 210. Subsequent retraction or reverse movement of the drive actuator 20 first returns the tonnage limiting means 262 to the original positions of the first and second mounts 264, 270, disconnecting the clamp 30 and seating the mounts against the first (lower) support so that the actuator 20 may then raise the upper (second) support away from the first support and allow removal of the hemmed panels.

Referring now to FIGS. 5–8 of the drawings, there is illustrated a fourth embodiment of hemming apparatus generally indicated by numeral 310. Apparatus 310 is to some extent an inverted version of the apparatus 210 just described with, however, certain differences to be made clear. In apparatus 310, the upper support 16 carries the clamp 30 and thus becomes the first support while the lower support 18 carries the clamp seat and thus becomes the second support as will be subsequently more fully described.

Figure 5:
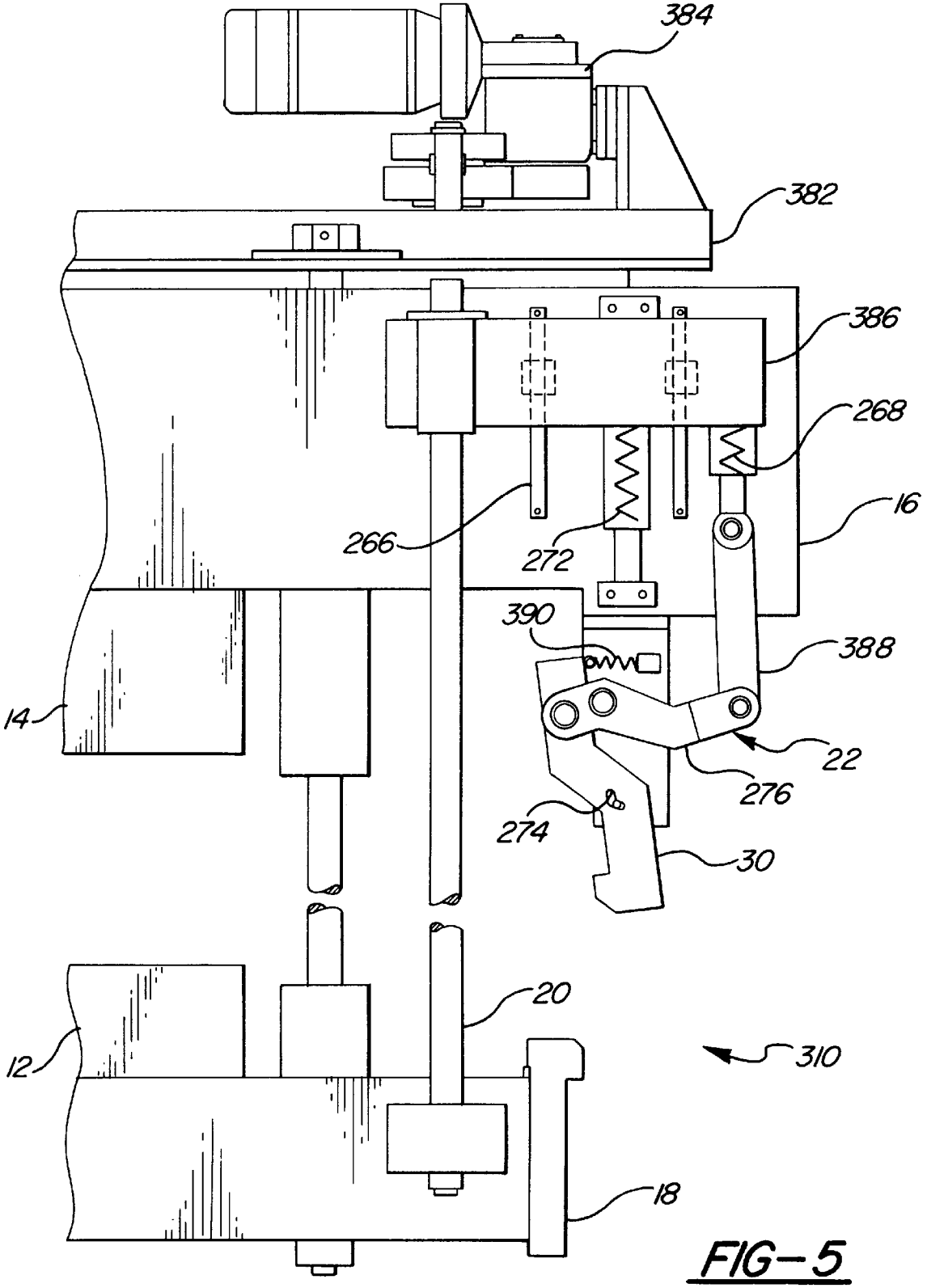
FIGS. 5–8 are fragmentary front views of a fourth embodiment of the invention shown in various positions in its sequence of operation.

FIG. 5 illustrates a portion of a machine frame 382 on which is mounted a motor drive 384 connected with one of the ball screw drive actuators 20 that cause relative motion of the supports 16, 18 toward and away from one another. The frame and motor drive, not illustrated in the other figures, are similar to those which might be used for driving the ball screws in any of the illustrated embodiments.

In the embodiment of FIGS. 5–8, the drive actuator 20 is directly connected with the second (lower) support 18 and with a carriage 386 mounted on linear bearings 266 carried by the first (upper) support 16 for relative vertical motion of the carriage 386 with respect to the first (upper) support 16. In the separated position of the dies 12, 14, the carriage 386 engages a stop through which the carriage supports the first (upper) support 16 in its raised position. Biasing spring means 272 extend between the carriage 386 and the upper first support 16 to bias the carriage against the upper stop. Overtravel spring means 268 connect the carriage 386 through a connecting rod 388 with an intensification lever arm 276 pivotally mounted between its ends to an extension of the first (upper) support. The clamp 30 is also pivotally mounted by a cam slot 274 between its ends to the extension of the upper first support. An additional pivoting spring 390 is provided to pivot the clamp 30 into a retracted position in its unclamped state.

Figure 6:
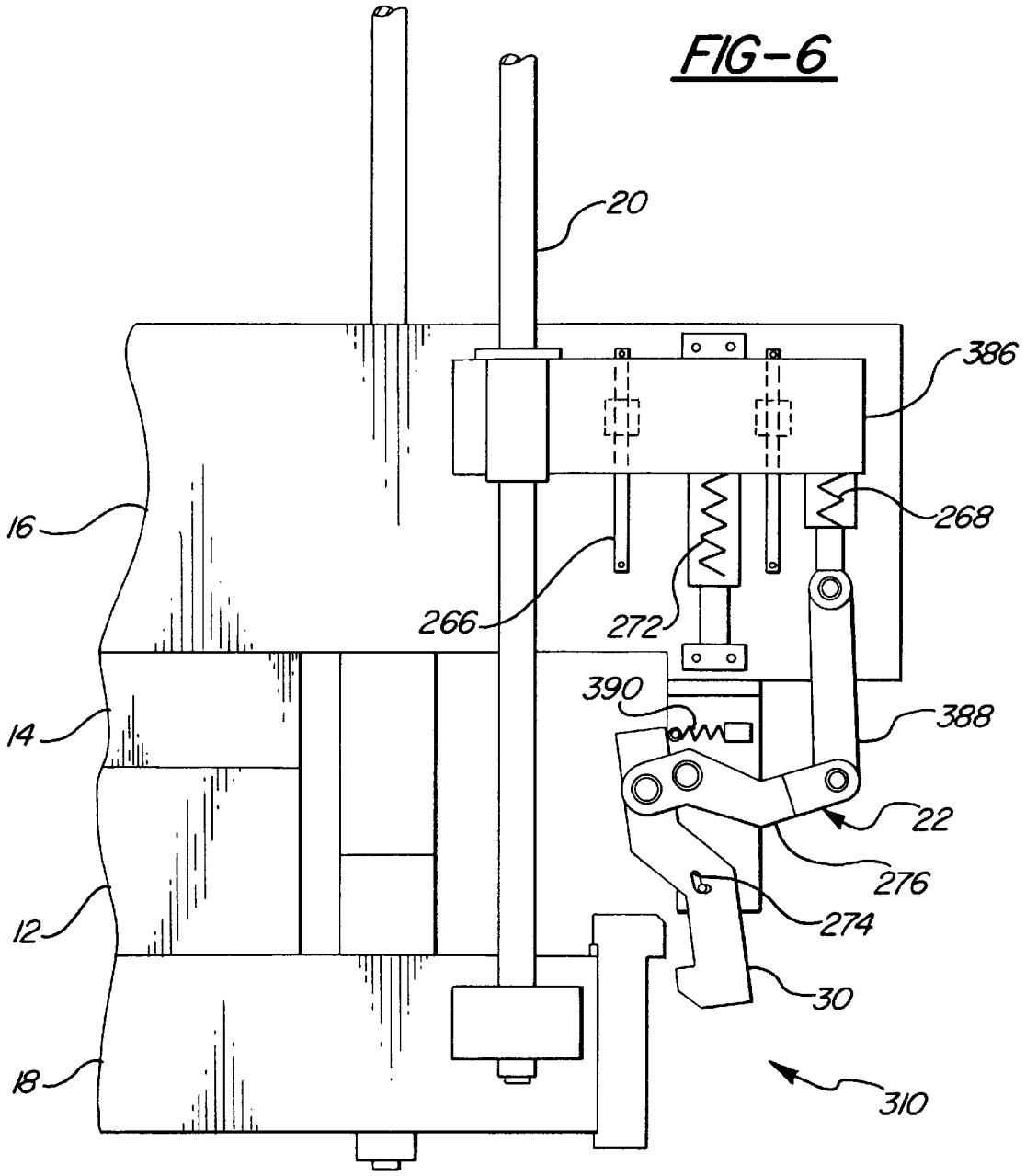

FIG. 5 illustrates the location of the components of hemming apparatus 310 when the dies 12, 14 are fully separated in position to receive a pair of panels, not shown, for hemming. When such panels are in place, the drive actuators 20 are operated to lower the first (upper) support (or raise the second (lower) support) until the dies 12, 14 are in contact as shown in FIG. 6.

Figure 7:
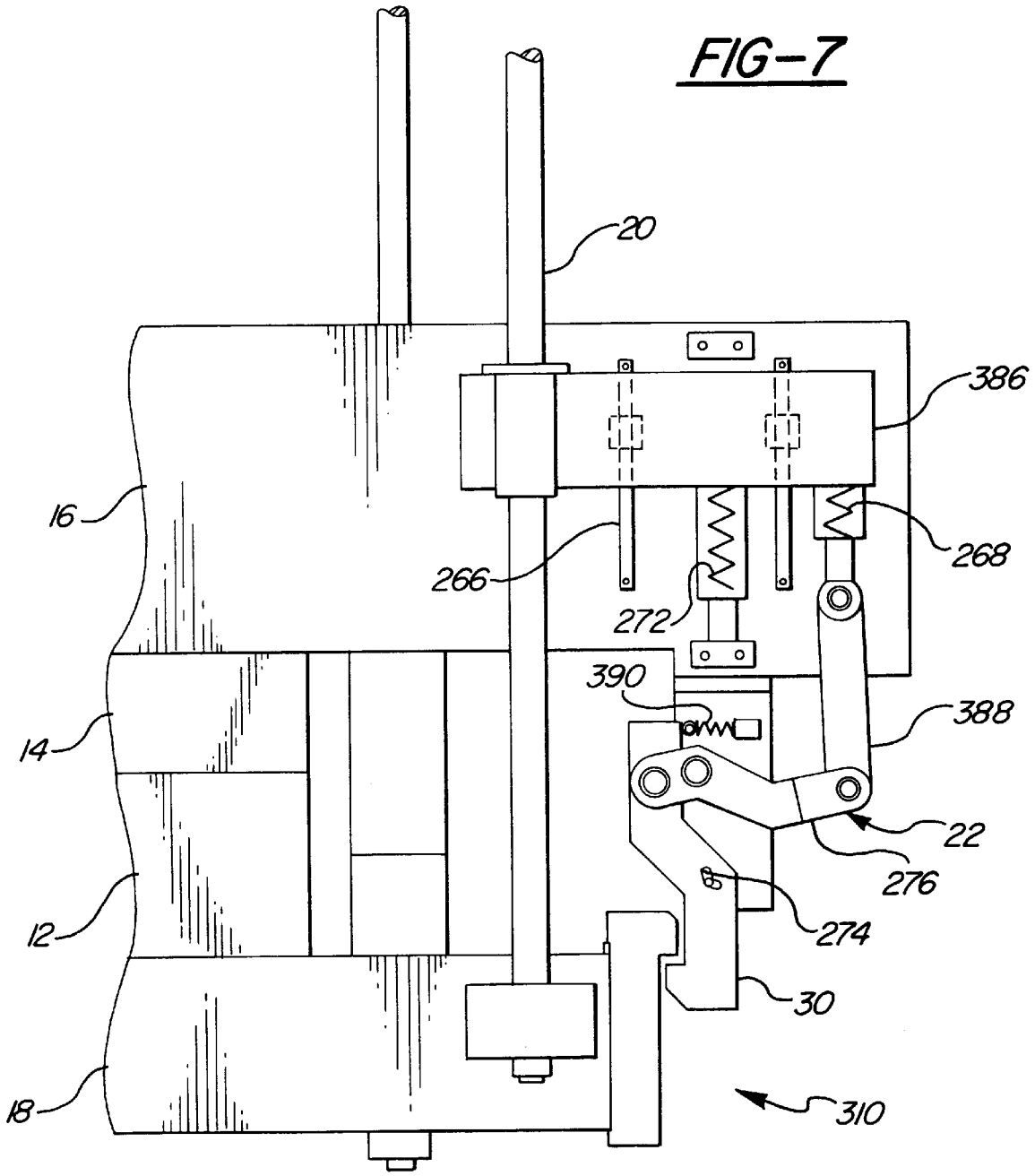

Further movement of the drive actuator 20 then moves the carriage 386 downward relative to the first (upper) support 16, sliding along the linear bearings 266 and compressing the biasing spring means 272. This action pivots the intensification lever arm 276 causing the clamp 30 to be pivoted inward at its first end 36 to a location below the associated clamp seat formed on the second (lower) support 18 as is shown in FIG. 7.

Figure 8:
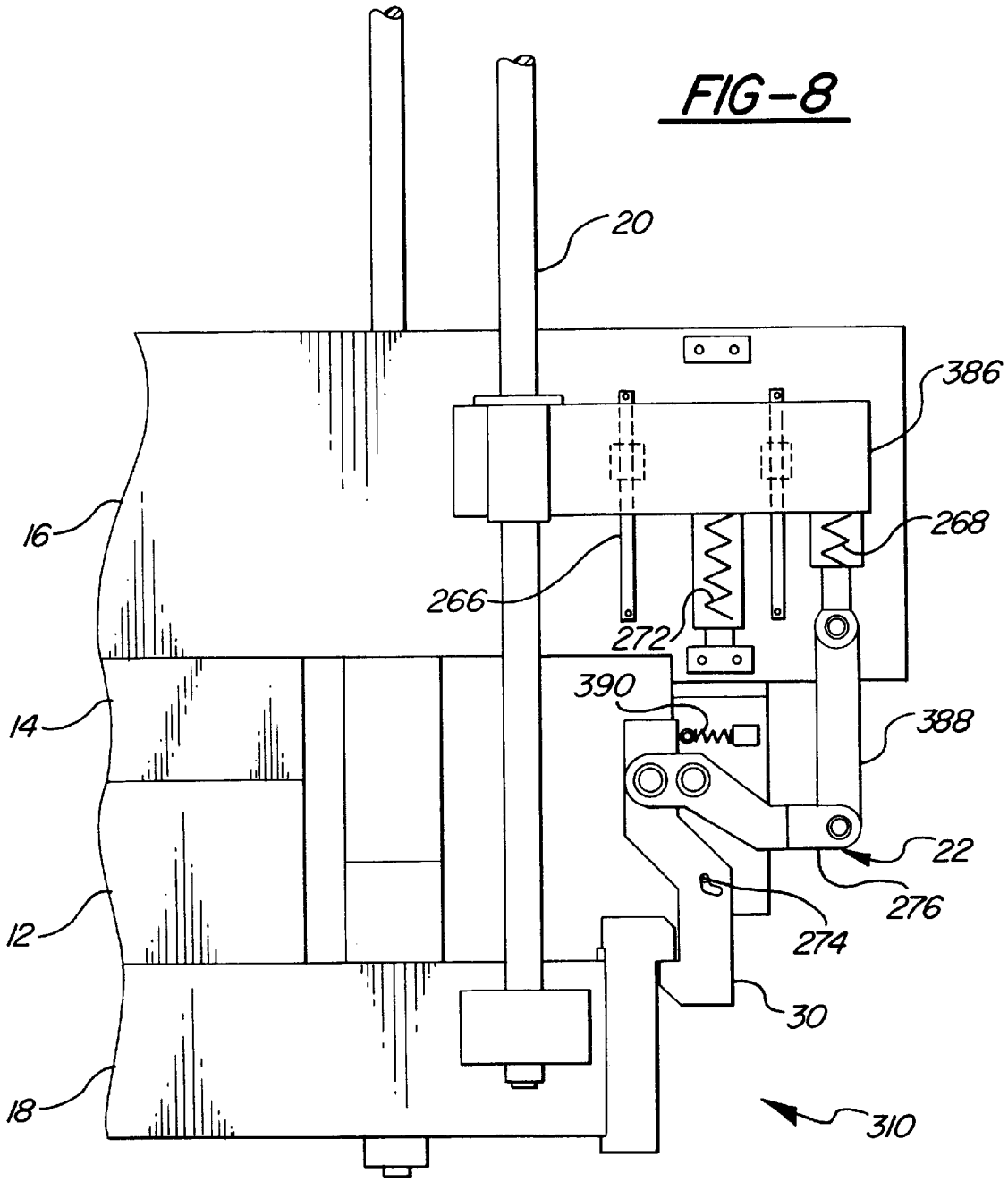

Continued actuation of the drive actuator 20 moves the carriage 386 further downward, pivoting the intensification lever arm 276 to the position shown in FIG. 8 and drawing the clamp 30 upward against the second (lower) support clamp seat so as to apply an intensified hemming force between the upper and lower supports to complete the hemming of the panels, not shown. Further overtravel of the carriage caused by continued operation of the actuators 20 causes compression of the overtravel spring means 268, thereby limiting the intensified hemming force provided by the intensification means 22, the overtravel spring means 268 thereby comprising the tonnage limiting means provided in this fourth embodiment of the invention.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A closure panel hemming apparatus comprising;

a lower support, a lower hemming die supported by said lower support, an upper support spaced from and mounted above said lower support, an upper hemming die supported by said upper support, said upper and lower supports being relatively vertically moveable for moving said dies toward and away from one another, a plurality of support drive actuators driveably connected to draw together said upper and lower supports bringing said dies together for hemming, a clamp pivotally mounted relative to a first support of said upper and lower supports and being operatively engageable with a second support of said upper and lower supports;

engagement actuating means for causing engagement of said clamp member with said second support; and force application means for moving said supports together during engagement of said clamp.

2. The apparatus of claim 1 wherein said clamp is of a modified C-shape.

3. The apparatus of claim 2 wherein said clamp includes:

first and second ends, said first end being pivotally mounted on said first support; and a link engageable with the said second support and pivotally connected to said clamp between said first and second ends.

4. The apparatus of claim 3 wherein said force application means is mounted on said clamp second end and has an operative connection with said link to pivot said link to bring a distal end of said link toward said first end of said clamp, thereby applying a hemming pressure between the supports proportional to the force of the force application means.

5. The apparatus of claim 4 wherein said force application means is a hydraulic cylinder.

6. The apparatus of claim 4 wherein said force application means is an air over oil cylinder.

7. The apparatus of claim 3 wherein said force application means is a crank arm assembly.

8. The apparatus of claim 4 wherein said engagement actuating means is;

a fluid actuator operatively connected between said first support and said clamp, intermediate said first end and said link, to pivot said clamp into and out of position for hemming upon actuation of said fluid cylinder.

9. The apparatus of claim 4 wherein said engagement actuating means includes a cam and follower operatively connecting said second support with said clamp to cam said clamp into and out of position upon relative motion of said supports.

10. The apparatus of claim 1 wherein said clamp includes:

first and second ends and a cam shaped slot for said pivotal mounting of the clamp between said first and second ends; and an intensification lever arm having first and second ends and pivotally mounted between its first and second ends to said first support;

said intensification lever arm first end being pivotally connected to said clamp first end; and said intensification lever arm second end being operatively connected for pivotal movement by one of said plurality of support actuators.

11. The apparatus of claim 10 including:

tonnage control means intermediate said intensification lever arm second end and said one of said plurality of support actuators for controlling the hemming pressure.

12. The apparatus of claim 11 wherein said tonnage control means includes:

a first mount mounted on said one of said plurality of actuators;

a second mount mounted on said first support;

first spring means compressible between said first and second mounts, and second spring means compressible between said second mount and said first support, said first spring means having greater compressive force than said second spring means;

said second mount pivotally mounting said intensification lever arm second end; and a linear bearing mounted on said first support;

said linear bearing mounting said first and second mounts for linear movement on said first support;

whereby, upon movement of said supports to a hemming position, continued movement of said one of said actuators drives said first and second mounts together along said linear bearing, compressing said second spring means and causing actuating movement of said intensification lever arm.

13. The apparatus of claim 11 wherein said tonnage control means includes:

a carriage mounted on said one of said plurality of actuators;

said first support including a linear bearing and mounting said carriage for movement relative to said support;

carriage spring means connecting said carriage and said support whereby said carriage is moved and said carriage spring means compressed after said one of said actuators has driven said supports to a hemming position; and compliance spring means operatively connecting said carriage and said intensification lever arm second end causing said intensification lever arm to be pivoted, compression of said compliance spring allowing overtravel of the carriage and limiting the intensified hemming force applied by the clamp.

14. The apparatus of claim 1 wherein said plurality of support drive actuators comprise ball screw actuators.

15. The apparatus of claim 1 wherein said plurality of support drive actuators comprise rack and pinion actuators.

16. The apparatus of claim 1 wherein said plurality of support drive actuators comprise linear drive actuators.

* * * * *